United States Patent [19]

Thiele et al.

[11] Patent Number: 4,944,407

[45] Date of Patent: Jul. 31, 1990

[54] PACKING CONTAINER

[75] Inventors: Harmut Thiele, Munich; Leo Gruber, Pentenried; José Toral, Munich, all of Fed. Rep. of Germany

[73] Assignee: Reel/Frame 5189/0412 Agfa-Gevaert Aktiengesellschaft, Leverkusen, Fed. Rep. of Germany

[21] Appl. No.: 447,714

[22] Filed: Dec. 8, 1989

[30] Foreign Application Priority Data

Dec. 22, 1988 [DE] Fed. Rep. of Germany ... 8815897[U]

[51] Int. Cl.[5] ..... B65D 5/54

[52] U.S. Cl. ..... 206/628; 206/620; 229/123.1; 229/160.2

[58] Field of Search ..... 229/160.2, 123.1; 206/609, 614, 620, 624, 628

[56] References Cited

U.S. PATENT DOCUMENTS

| | | | |
|---|---|---|---|
| 2,661,139 | 12/1953 | Brooks | 229/123.1 |
| 3,302,857 | 2/1967 | Martin | 206/628 |
| 3,542,192 | 11/1970 | Steck | 206/628 |
| 3,593,911 | 7/1971 | Pellaton | 206/624 |
| 4,796,760 | 1/1989 | Rausing | 206/628 |

FOREIGN PATENT DOCUMENTS

| | | | |
|---|---|---|---|
| 3515354 | 10/1986 | Fed. Rep. of Germany | 206/624 |
| 459734 | 1/1937 | United Kingdom | 206/624 |

*Primary Examiner*—Gary E. Elkins
*Attorney, Agent, or Firm*—Connolly and Hutz

[57] ABSTRACT

A square packing container is described, manufactured from a one-piece blank comprising a base and a lid portion and side wall surfaces located thereon, which are connected to one another by means of connecting tabs, and wherein weakened lines are formed on the side wall surfaces. According to the invention, the weakened lines (9, 9', 10, 10', 11) are formed approximately in the plane of symmetry of the side wall surfaces (3, 4), and moreover, two perforated tabs (5, 6) are formed on at least one side wall (3). An adhesive tape (12) encircling the side wall surfaces is stuck on to the projections (5', 6') of the perforated tabs (5, 6), each in the direction of the side edges (7, 8), with the adhesive tape (12) connecting the side tabs (13, 13' and 14, 14') of the base portion (15) and the lid portion (16) with one another.

4 Claims, 2 Drawing Sheets

PACKING CONTAINER

The invention relates to a square packing container, manufactured from a one piece blank comprising a base and a lid portion and side wall surfaces located thereon, which can be connected to one another by means of connecting tabs, and wherein weakened lines are formed on the side wall surfaces. Packing containers, which are often used as shipping cases, are generally sealed by means of an adhesive tape. Auxiliary means (blades, scissors) must be used to open these containers, which has the disadvantage that the packaged articles will be damaged if the containers are opened incorrectly, and there is also a risk of injury for the person operating the opening devices.

Other packing containers, described, e.g. in DE 25 33 205 and 29 46 014, comprise scores or perforated lines as means for opening the package. In this case, there is a risk that these weakened lines may even tear open during transportation, thus damaging the contents. Moreover, as only the lid folds back after one of the above-mentioned packing containers has been torn open, extra finger indents must be formed in the side walls so that the packaged contents, e.g. magnetic tape cassettes, can be removed.

Furthermore, packing containers with tear strips are known in the prior art, described, e.g. in DE-U 16 68 076, DE-A 31 40 389 and 35 08 093, and EP 0 199 225, in which the tear strips are partly connected to pull tabs for tearing open the package.

The object of the invention is to develop a packing container with a simple construction, and having an integral opening mechanism, so that the container can be opened without the use of auxiliary means and with no risk of injury to the person opening the container or of damage to the packaged articles, and which in a preferred embodiment is suitable for shipping stacked reels.

The problem is solved according to the invention by means of a packing container having the features specified in the characterizing part of claim 1. Further details of the invention will be clear from the subclaims, drawings and description.

The invention will now be described in more detail with reference to the accompanying drawings, in which.

Figure 1:
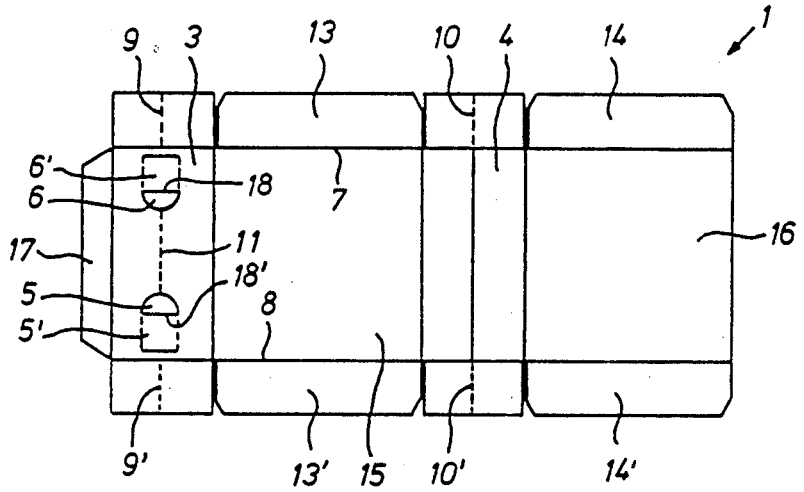
FIG. 1 shows a blank of the packing container according to the invention.
Figure 2:
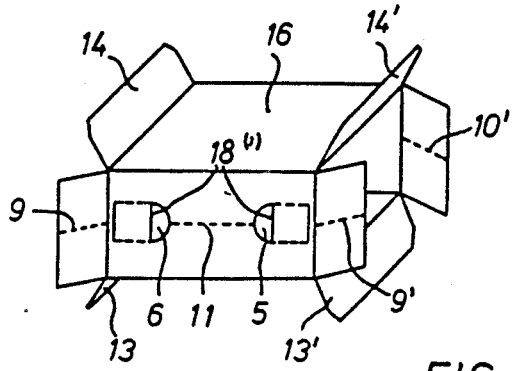
FIG. 2 shows the packing container according to FIG. 1 in a partially folded state.

If the one-piece blank (1) according to FIG. 1 is folded up, the side tabs on the side walls (3, 4) and the side tabs (13, 13', 14, 14') on the base portion (15) and the lid portion (16) are folded over along the scored lines (7, 8). The tab (17) on the side portion (3) is connected to the lid portion (16), e.g. by glueing. The packing container is illustrated in its partially folded state in FIG. 2.

According to the invention, the tabs on the side walls (3, 4) and the side wall (3) comprise perforated weakened lines (9, 9', 10, 10', 11) forming breaking lines approximately in their geometric centres. Moreover, two perforated tabs (5, 6) are formed between the weakened lines on at least one side wall (3). Said perforated tabs (5, 6) each being provided with an extension (5', 6') in the direction of the edges (7, 8) of the container. In the preferred embodiment,, the weakened line (10, 10') is only formed on the side tabs on the side wall (4). A scored line (18, 18') or folding line is provided between each tab and its extension.

Figure 3:
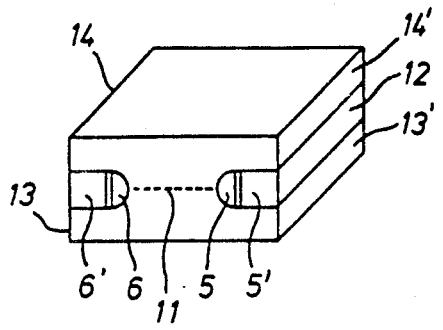
FIG. 3 shows the packing container in a closed state.

After the article to be packaged has been inserted the container is sealed, an adhesive tape (12) (FIG. 3) being stuck on starting at the extension (5') of the tab (5), encircling the three side walls, and extending to the extension (6') of the second tab (6), the side tabs (13, 13', 14, 14') being connected to one another. Only the weakened point (11) is left free. The width of the adhesive tape is the same or slightly less than the width of the tabs (5, 6).

Figure 4:
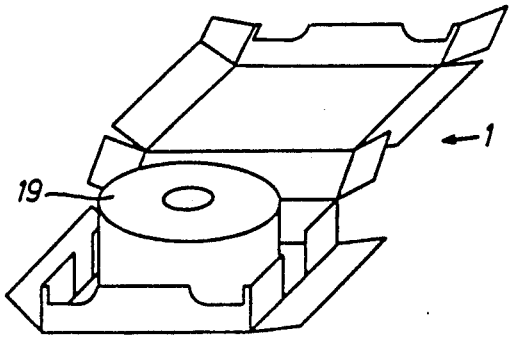
FIG. 4 shows the packing container and the packaged articles after opening.

The packing container according to the invention is opened as follows. First, one of the tabs is pressed in or pushed through by the finger. The word "PRESS" can be imprinted on the tabs to facilitate handling. The tab can then be gripped through the grip hole produced. There should be a small hollow space approximately the width of the grip hole or the width of a finger behind the tab. The tab is then gripped and pulled out. The adhesive tape, which is secured to the extension of the tab, is thus also pulled up and can be easily separated from the packing container. One side of the packing container is thus open. The same process is followed for the second tab, both sides of the packing container thus being open. As a result of the openings produced when the tabs are pulled out, the packing container can now be opened at the weakened point (11), so that the packing container can now be opened out like a book and the exposed contents of the package can be removed without difficulty (FIG. 4). This is a significant handling advantage when the contents (19) of the package are heavy. A further advantage consists in that the opened out packing container, which no longer has any residual stress, lies flat and therefore can be disposed of more easily. The hitherto troublesome shredding of the container for refuse disposal by the ultimate user is therefore no longer necessary.

It is clear from the above description that the packing container according to the invention can be used in a preferred manner for shipping finished reels or pancakes stacked on top of one another, e.g. for magnetic tapes, as, owing to their cylindrical shape, there can be a hollow space behind each of the tabs in the interior of the packing container. However, it is obvious to any expert in the packaging sphere that square objects can also be used advantageously in the container according to the invention. In this case, e.g. there can be a hollow space behind the tab, produced by an inserted layer of board.

The material for the packing container according to the invention can be board or corrugated board, and the cardboard packaging material can also be laminated with a plastic coating.

We claim:

1. Square packing container, manufactured from a one-piece blank comprising a base and a lid portion and side wall surfaces located thereon, which can be connected to one another by means of connecting tabs, and wherein weakened lines are formed on the side wall surfaces, characterised in that the weakened lines (9, 9', 10, 10', 11) are formed approximately in the plane of symmetry of the side wall surfaces (3, 4) and that two perforated tabs (5, 6) are formed on at least one side wall (3), an adhesive tape (12) encircling the side wall surfaces being stuck on to extensions (5', 6') of the said perforated tabs (5, 6), each in the direction of the side edges (7, 8), said adhesive tape (12) connecting the side tabs (13, 13' and 14, 14') of the base portion (15) and the lid portion (16) with one another.

2. Packing container according to claim 1, characterized in that the blank consists of board or corrugated board.

3. Packing container according to claims 1 or 2, characterised in that the width of the adhesive tape (12) is approximately the same as the width of the tabs (5, 6).

4. Packing container according to claims 1 or 2 characterised in that a scored line or folding line (18, 18') is formed between each tab (5, 6) and its extension (5', 6').

* * * * *